US009284798B2

(12) United States Patent
Jamison et al.

(10) Patent No.: US 9,284,798 B2
(45) Date of Patent: Mar. 15, 2016

(54) METHODS AND COMPOSITIONS FOR TREATING SUBTERRANEAN FORMATIONS WITH SWELLABLE LOST CIRCULATION MATERIALS

(71) Applicant: Halliburton Energy Services, Inc., Houston, TX (US)

(72) Inventors: Dale E. Jamison, Houston, TX (US); Robert J. Murphy, Houston, TX (US); Matthew L. Miller, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/770,110

(22) Filed: Feb. 19, 2013

(65) Prior Publication Data

US 2014/0231086 A1 Aug. 21, 2014

(51) Int. Cl.
*E21B 33/00* (2006.01)
*E21B 21/00* (2006.01)

(52) U.S. Cl.
CPC ..... *E21B 21/003* (2013.01)

(58) Field of Classification Search
CPC ..... E21B 21/003; E21B 27/00; E21B 27/02; E21B 33/00; E21B 33/10; E21B 33/13; E21B 33/134; E21B 33/138
See application file for complete search history.

(56) References Cited

U.S. PATENT DOCUMENTS 4,664,816 A * 5/1987 Walker ..... 507/103
4,704,213 A * 11/1987 Delhommer et al. ..... 175/72
5,905,061 A 5/1999 Patel
5,977,031 A 11/1999 Patel
6,528,157 B1 3/2003 Hussain et al.
6,828,279 B2 12/2004 Patel et al.
6,861,392 B2 3/2005 Shaarpour
7,066,285 B2 6/2006 Shaarpour
7,108,066 B2 9/2006 Jamison
7,455,112 B2 11/2008 Moorehead et al.
7,482,309 B2 1/2009 Ravi et al.
7,490,667 B2 2/2009 Sinclair et al.
7,494,544 B2 * 2/2009 Go Boncan ..... 106/672
7,534,744 B2 5/2009 Shaarpour
7,534,745 B2 5/2009 Taylor et al.
7,645,723 B2 1/2010 Kirsner et al.

(Continued)

FOREIGN PATENT DOCUMENTS

WO 2011161569 A2 12/2011
WO 2014130279 A1 8/2014
WO 2014130293 A1 8/2014

OTHER PUBLICATIONS

Halliburton Article, Diamond Seal® Absorbent Polymer for Lost Circulation, 2008.

(Continued)

*Primary Examiner* — Angela M DiTrani
*Assistant Examiner* — Andrew H Sue-Ako
(74) *Attorney, Agent, or Firm* — McDermott Will & Emery LLP; Holly Soehnge

(57) ABSTRACT

Methods of treating a fluid loss zone in a wellbore in a subterranean formation including providing swellable particles having an initial unswelled volume, wherein the swellable particles upon swelling adopt a specific shape; introducing the swellable particles into the wellbore in the subterranean formation; and swelling the swellable particles so as to adopt a swelled volume beyond the initial unswelled volume; and sealing at least a portion of the fluid loss zone.

19 Claims, 3 Drawing Sheets

(56) References Cited

U.S. PATENT DOCUMENTS

| | | | | |
|---|---|---|---|---|
| 7,645,725 | B2 | 1/2010 | Weaver et al. | |
| 7,687,571 | B2 * | 3/2010 | Vaidya et al. | 524/543 |
| 7,696,131 | B2 | 4/2010 | Oyler et al. | |
| 7,717,180 | B2 | 5/2010 | Badalamenti et al. | |
| 7,741,247 | B2 | 6/2010 | Wang | |
| 7,836,952 | B2 | 11/2010 | Fripp | |
| 7,849,923 | B2 | 12/2010 | Burukhin et al. | |
| 7,866,393 | B2 | 1/2011 | Badalamenti et al. | |
| 7,891,424 | B2 * | 2/2011 | Creel et al. | 166/286 |
| 7,900,702 | B2 | 3/2011 | Reddy et al. | |
| 7,931,089 | B2 | 4/2011 | Miller et al. | |
| 7,972,555 | B2 * | 7/2011 | Polizzotti et al. | 264/572 |
| 8,043,997 | B2 | 10/2011 | Whitfill et al. | |
| 8,091,637 | B2 | 1/2012 | Fripp | |
| 8,132,623 | B2 | 3/2012 | Allin et al. | |
| 8,202,824 | B2 | 6/2012 | Reddy et al. | |
| 8,307,916 | B1 * | 11/2012 | Wald | 175/72 |
| 8,701,774 | B2 | 4/2014 | Johnson, Sr. | |
| 8,757,259 | B2 | 6/2014 | Lesko et al. | |
| 8,789,595 | B2 | 7/2014 | Guerrero et al. | |
| 9,175,529 | B2 | 11/2015 | Jamison et al. | |
| 2007/0181224 | A1 * | 8/2007 | Marya et al. | 148/400 |
| 2008/0017374 | A1 | 1/2008 | Surjaatmadja | |
| 2008/0108524 | A1 * | 5/2008 | Willberg et al. | 507/225 |
| 2008/0149345 | A1 * | 6/2008 | Marya et al. | 166/376 |
| 2009/0090559 | A1 * | 4/2009 | Polizzotti et al. | 175/65 |
| 2009/0163388 | A1 * | 6/2009 | Reddy et al. | 507/205 |
| 2009/0211770 | A1 | 8/2009 | Nutley et al. | |
| 2010/0004146 | A1 * | 1/2010 | Panga et al. | 507/212 |
| 2010/0071902 | A1 | 3/2010 | Ziegler | |
| 2010/0089581 | A1 | 4/2010 | Nguyen et al. | |
| 2010/0193244 | A1 * | 8/2010 | Hoskins | 175/5 |
| 2010/0263870 | A1 | 10/2010 | Willberg et al. | |
| 2011/0024988 | A1 * | 2/2011 | Ryan et al. | 277/316 |
| 2011/0048720 | A1 | 3/2011 | Diaz et al. | |
| 2011/0056752 | A1 | 3/2011 | Young et al. | |
| 2012/0067581 | A1 * | 3/2012 | Auzerais et al. | 166/308.1 |
| 2012/0285692 | A1 | 11/2012 | Potapenko et al. | |
| 2014/0231082 | A1 | 8/2014 | Jamison et al. | |

OTHER PUBLICATIONS

Halliburton Product Data Sheet STOPPIT™, Lost Circulation Material, 2012.

Prescribed Pattern Transformation in Swelling Gel Tubes by Elastic Instability, Phys. Rev. Lett. 108, 214304 (2012).

International Search Report and Written Opinion for PCT/US2014/015784 dated May 19, 2014.

International Search Report and Written Opinion for PCT/US2014/015537 dated Apr. 30, 2014.

* cited by examiner

METHODS AND COMPOSITIONS FOR TREATING SUBTERRANEAN FORMATIONS WITH SWELLABLE LOST CIRCULATION MATERIALS

BACKGROUND

The present invention relates to methods and compositions for treating subterranean formations with swellable lost circulation materials.

Hydrocarbon producing wells are typically formed by drilling a wellbore into a subterranean formation. A drilling fluid is circulated through a drill bit within the wellbore as the wellbore is being drilled. The drilling fluid is produced back to the surface of the wellbore with drilling cuttings for removal from the wellbore. The drilling fluid maintains a specific, balanced hydrostatic pressure within the wellbore, permitting all or most of the drilling fluid to be produced back to the surface. However, the hydrostatic pressure of the drilling fluid may be compromised if the drill bit encounters certain unfavorable subterranean zones, such as low pressure zones caused by natural fissures, fractures, vugs, or caverns, for example. Similarly, if the drill bit encounters high pressure zones, crossflows or an underground blow-out may occur. The compromised hydrostatic pressure of the drilling fluid causes a reduction of drilling fluid volume returning to the surface, termed "lost circulation." In addition to drilling fluids, other operational treatment fluids, such as fracturing fluid, may be lost to the subterranean formation due to fluid loss. The term "lost circulation" refers to loss of a drilling fluid, while the term "fluid loss" is a more general term that refers to the loss of any type of fluid into the formation. As a result, the service provided by the treatment fluid is often more difficult to achieve or suboptimal.

The consequences of lost circulation or fluid loss can be economically and environmentally devastating, ranging from minor volume loss of treatment fluids, to delayed drilling and production operations, to an underground well blow-out. Therefore, the occurrence of lost circulation or fluid loss during hydrocarbon well operations typically requires immediate remedial steps. Remediation often involves introducing a composition into the wellbore to seal unfavorable subterranean zones and prevent leakoff of the treatment fluids within the formation to unfavorable zones ("fluid loss zones"). Such compositions are generally referred to as "fluid loss control materials" or "FLCM."

Typical FLCMs are roughly spherical, having a sphericity of about 0.7 to about 1, and formed from cementitious material, flexible polymeric material, or naturally occurring materials (e.g., nut shell pieces or cellulosic materials), for example. In some cases, multiple FLCM types are mixed and used together to treat fluid loss in order to gain the functional benefit of each type.

Traditional FLCMs, however, may only partially seal a fluid loss zone, particularly when the fluid loss zone is a large cavernous or vugular zone. Multiple factors may affect the success of a fluid loss control operation, including, but not limited to, the wellbore size, the wellbore depth, the types of treatment fluids used, the drill bit nozzle size, and the FLCM shape and size. For instance, a particular sized and shaped FLCM may be required to adequately treat a formation, but is of such a size and shape that it interferes with the pumpability of the operational fluid into the wellbore, causing potential damage to drilling equipment and delay. Additionally, traditional FLCMs may form insufficient contact among one another to withstand stresses within the subterranean formation (e.g., the stresses of formation itself, the fluid loss zone, other FLCM particulates, the stress of flowing treatment fluids, and the like). Traditional FLCMs may also fail to interact with one another to sufficiently prevent treatment fluids from leaking-off into a formation due to the presence of interstitial spaces between aggregated individual FLCMs. This may be particularly so if the FLCMs are of similar shapes and sizes. Moreover, the presence of such interstitial spaces may result in a widening of the interstitial spaces as fluid flows through, thereby compounding the fluid loss problem. Accordingly, an ongoing need exists for methods and compositions of blocking the flow of fluid through fluid loss zones in a subterranean formation.

SUMMARY OF THE INVENTION

The present invention relates to methods and compositions for treating subterranean formations with swellable lost circulation materials.

In some embodiments, the present invention provides a method of treating a fluid loss zone in a wellbore in a subterranean formation comprising: providing swellable particles having an initial unswelled volume, wherein the swellable particles upon swelling adopt a specific shape; introducing the swellable particles into the wellbore in the subterranean formation; and swelling the swellable particles so as to adopt a swelled volume beyond the initial unswelled volume; and sealing at least a portion of the fluid loss zone.

In other embodiments, the present invention provides a method of treating a fluid loss zone in a wellbore in a subterranean formation comprising: providing a hollow, flexible member having at multiple ends and a shape; providing a swellable particle having an initial unswelled volume; placing the swellable particle into a first portion of the hollow, flexible member, while leaving a second portion empty; collapsing the second portion of the hollow, flexible member around the swellable particle so as to form a collapsed swellable particle having a volume approximately equivalent to the initial unswelled volume of the swellable material; introducing the collapsed swellable particle into the wellbore in the subterranean formation; and swelling the swellable particle so as to adopt a swelled volume beyond the initial unswelled volume, wherein the swelling of the swellable particle causes the swellable particle take the shape of the hollow, flexible member so as to form an encased swelled fluid loss particle; and sealing at least a portion of the fluid loss zone.

The features and advantages of the present invention will be readily apparent to those skilled in the art upon a reading of the description of the preferred embodiments that follows.

BRIEF DESCRIPTION OF THE FIGURES

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1A:
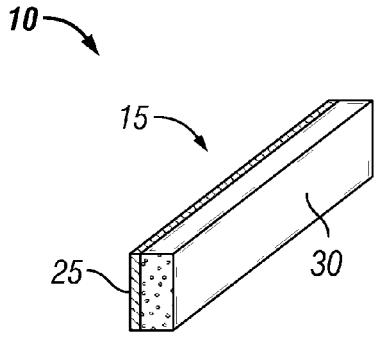
FIGS. 1A and 1B show a crescent-shaped swellable particle formed from coextrusion of a nonswellable polymer and a swellable polymer of the present invention in its initial unswelled rectangle-shape (FIG. 1A) and its swelled crescent-shape (FIG. 1B).

The present invention relates to methods and compositions for treating subterranean formations with swellable lost circulation materials.

The present invention provides for methods of effectively plugging fluid loss zones using swellable FLCMs that do not cause pumping problems during hydrocarbon well operations. The methods taught in this disclosure use swellable FLCMs having various shapes that are capable of themselves swelling and sealing a fluid loss zone alone or that capable of interacting with one another so as to create an entangled mass. As used herein, the term "entangled mass" refers to the overlapping or intertwining of at least a portion of a first swellable FLCM of the present invention with at least a portion of a second swellable FLCM of the present invention. The swellable FLCMs alone or the entangled mass of swellable FLCMs of the present invention may not only serve to control fluid loss, but may also serve as consolidating materials, capable of trapping loose material in the subterranean formation (formation fines), for example. As used herein, the term "consolidating material" refers to a material capable of controlling the undesireable production of materials (e.g., formation fines) to the surface during hydrocarbon well production.

In some embodiments, the present invention provides for method of treating a fluid loss zone in a wellbore in a subterranean formation with swellable particles. The swellable particles have an initial unswelled volume and a pre-defined shape. Upon introducing the swellable particles into a subterranean formation, the swellable particles swell to adopt a swelled volume larger than the unswelled volume and the pre-defined shape, so as to seal at least a portion of the fluid loss zone.

The swellable particles of the present invention may be of any material capable of swelling upon introduction into a subterranean formation, so long as the material does not interfere with the methods of the present invention. In preferred embodiments, the swellable particles of the present invention are formed from a swellable polymer or a salt of swellable polymeric material. Suitable examples of swellable polymers that may form the swellable particles of the present invention include, but are not limited to, cross-linked polyacrylamide; cross-linked polyacrylate; cross-linked copolymers of acrylamide and acrylate monomers; starch grafted with acrylonitrile and acrylate; cross-linked polymers of two or more of allylsulfonate; 2-acrylamido-2-methyl-1-propanesulfonic acid; 3-allyloxy-2-hydroxy-1-propanesulfonic acid; acrylamide, acrylic acid monomers; and any combination thereof in any proportion. Suitable examples of salts of polymeric material that may form the swellable particles of the present invention include, but are not limited to, salts of carboxyalkyl starch; salts of carboxymethyl starch; salts of carboxymethyl cellulose; salts of cross-linked carboxyalkyl polysaccharide; starch grafted with acrylonitrile and acrylate monomers; and any combination thereof. An example of a suitable commercially available swellable polymer that may form the swellable particles of the present invention includes, but is not limited to, DIAMOND SEAL®, available from Halliburton in Houston, Tex. The specific features of the swellable particles of the present invention may be chosen based on the type and conditions of the subterranean formation being treated, the size and porosity of the fluid loss zone to be treated, and the like.

In some embodiments, the swellable particles may be comprised of a coextruded polymer or salt of polymeric material. As used herein, the term "coextruded" refers to the extrusion of multiple layers of a polymer or salt of polymeric material simultaneously. For example, in some embodiments, a polymer or salt of polymeric material with more tensile strength may be used as an outer, shape-defining material and a more flexible polymer or salt of polymeric material may be used as the inner core. In other embodiments, a polymer or salt of polymeric material with more tensile strength may be used as the inner core and a more flexible polymer or salt of polymeric material may be used as the outer core. In still other embodiments, a non-swelling polymer may be coextruded with the swellable particles of the present invention. By way of nonlimiting example, a non-swellable polymer may be coextruded so as to flank a swellable particle of the present invention, such that the swellable particle has a non-swellable polymer surrounding it. In these cases, the swellable particle is typically non-spherical or the coextrusion is asymmetric, which facilitates curing of the swellable particle while maintaining adequate stiffness. Polymers that are substantially nonswellable or nonswellable may be of any polymer known in the art suitable for use in a subterranean operation. Suitable nonswellable polymers may include, but are not limited to, polyurethane; carboxylated butadiene-styrene rubber; polyester; polyacrylate; and any combination thereof. One of ordinary skill in the art, with the benefit of this disclosure, will know what nonswellable polymer to use in the methods of the present invention given a particular application.

The swellable particles of the present invention are capable of swelling upon contact with a swelling agent. The swelling agent for the swellable particulate can be any agent that causes the swellable particulate to swell via absorption of the swelling agent. The swelling agents for use in combination with the swellable particles of the present invention may be water-swellable; oil-swellable; or a combination thereof. In a some embodiments, the swellable particle is "water swellable," meaning that the swelling agent is water. The term "water-swellable" encompasses swellable particles that swell upon contact with an aqueous fluid, but only if the aqueous fluid possesses a particular property (e.g., a particular salinity, temperature, pH, and the like). Suitable sources of water for use as the swelling agent include, but are not limited to, fresh water; brackish water; seawater; brine; and any combination thereof. In another embodiment of the invention, the swellable particle is "oil swellable," meaning that the swelling agent for the swellable particle is an organic fluid. The term "oil-swellable" encompasses swellable particles that swell upon contact with an organic fluid, but only if the organic fluid possesses a particular property (e.g., a particular type of hydrocarbon, temperature, and the like). Examples of organic swelling agents include, but are not limited to, diesel; kerosene; crude oil; synthetic oil; and any combination thereof.

The swellable particles are introduced into a subterranean formation during a hydrocarbon well operation prior to swelling. That is, they have an unswelled volume. Typically, the unswelled volume of the swellable particles of the present invention is less than about 15 mm in diameter. The unswelled volume is of a size such that it does not produce pumping problems when pumped into a subterranean formation in high concentrations. Upon swelling, the swellable particles may increase in size up to about four times (or 400%) the unswelled volume. In some embodiments, it may be preferred that the swellable particles swell less than four times the unswelled volume (e.g., 350%, 300%, 250%, 200%, 150%, 100%, or 50%, for example).

The swellable particles of the present invention may have a pre-determined shape or may be capable of forming to the shape of a confined area in which the swelled particle is confined upon swelling. In those embodiments where the swellable particles have a pre-determined shape, the shape may or may not be evident prior to swelling. That is, if the shape of the swellable particle is cross-shaped, prior to swelling the swellable particle may exhibit some other shape, such as a pellet shape, for example. Suitable shapes that the swellable particles of the present invention may adopt at least in their swelled volume include, but are not limited to, spherical-shaped; cubic-shaped; rod-shaped; rectangle-shaped; cone-shaped; ellipse-shaped; cylinder-shaped; polygon-shaped; pyramid-shaped; torus-shaped; cross-shaped; lattice-shaped; star-shaped; crescent-shaped; bowtie-shaped; semi-circle-shaped; spiral-shaped; and any combination thereof. The shape of the swelled swellable particle may be selected based on the fluid zone to be controlled. For example, for large vugular fluid loss zones, it may be preferred to select a high concentration of long, slender shaped swellable particles, such as crescent-shaped swellable particles, that may act only or interact with one another so as to form a complex entangled mass. In other embodiments, swellable particles that are substantially spherical may be preferred.

In those embodiments where the swellable particle has a predefined shape, it may be preferable to use the coextruded swellable particles of the present invention to define or control that shape. The coextruded swellable particles may be coextruded with other swellable particles or with substantially nonswellable or nonswellable polymers.

Figure 1B:
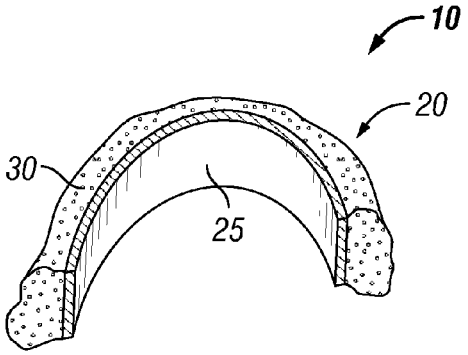

Referring now to the figures, in FIG. 1A, crescent-shaped swellable particle 10 is shown in its rectangle-shaped unswelled form 15. Non-swellable polymer 25 flanks swellable particle 30 of the present invention. FIG. 1B shows the crescent-shaped swelled form 20 of crescent-shaped swellable particle 10, where the crescent-shape is due to the swelling of swellable particle 30, which contorts or bends non-swellable polymer 25.

Figure 2A:
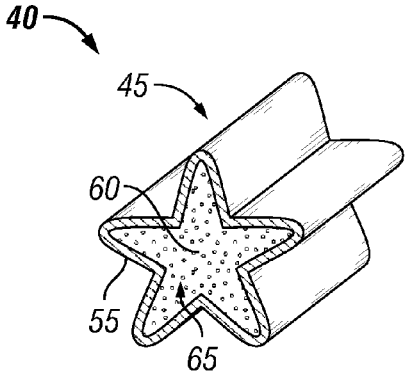
FIGS. 2A and 2B show a star-shaped swellable particle formed from coextrusion of a nonswellable polymer and a swellable polymer of the present invention in its initial unswelled star-shape (FIG. 2A) and its swelled star-shape (FIG. 2B).
Figure 2B:
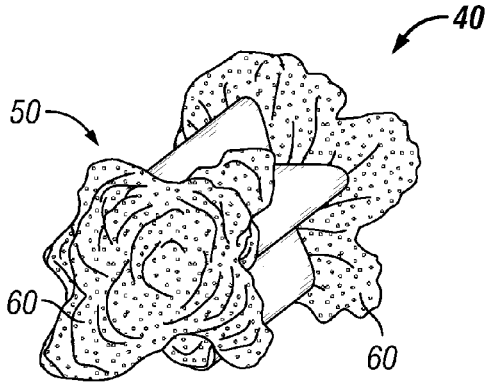

In FIG. 2A, star-shaped swellable particle 40 is shown in its unswelled form 45. Non-swellable polymer 55 forms the outer core of the unswelled form 45 of star-shaped swellable particle 40 and swellable particle 60 forms the inner core 65 of the unswelled form 45 of star-shaped swellable particle 40. FIG. 2B shows the star-shaped swelled form 50 of star-shaped swellable particle 40 after swelling the swellable particle 60.

Figure 3A:
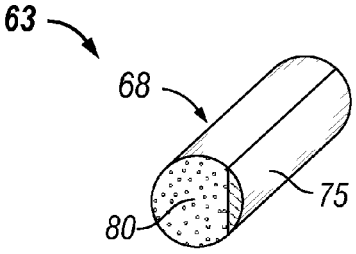
FIGS. 3A and 3B depict a crescent-shaped swellable particle formed from coextrusion of a nonswellable polymer and a swellable polymer of the present invention in its initial unswelled cylinder-shape (FIG. 3A) and its swelled crescent-shape (FIG. 3B).
Figure 3B:
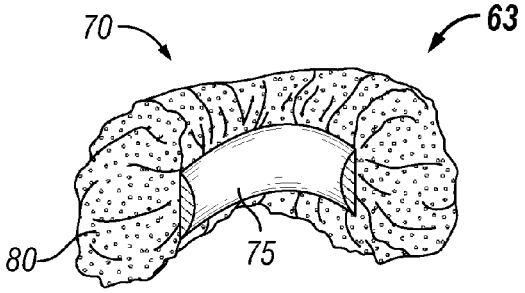

In FIG. 3A, crescent-shaped swellable particle 63 is shown in its cylinder-shaped unswelled form 68. Non-swellable polymer 75 flanks swellable particle 80 of the present invention. FIG. 3B shows the crescent-shaped swelled form 70 of crescent-shaped swellable particle 63, where the crescent-shape is due to the swelling of swellable particle 80, which contorts or bends non-swellable polymer 75.

In those embodiments where the swellable particles of the present invention conform to the shape of a confined area in which they are confined, the swellable particles may be included within a hollow, flexible member so as to completely fill the hollow, flexible member. In other embodiments, it may be preferred that the swellable particle only fill a portion of the hollow, flexible member. This may be preferred so as to utilize the non-filled portion of the hollow, flexible member as an agent to encourage interaction among individual encased swelled fluid loss particles or other particulates. In still other embodiments, the hollow, flexible member may itself expand (i.e., due to the nature of the material forming the hollow, flexible member) so as to allow the swellable particle to fully swell. The preferred swelled volume may be dependent upon, for example, the size and shape of the targeted fluid loss zone.

In some embodiments, the present invention provides a method of treating a fluid loss zone in a wellbore in a subterranean formation comprising providing a hollow, flexible member having at multiple ends and a shape and a swellable particle having an initial unswelled volume. The swellable particle is placed into a first portion of the hollow, flexible member, while leaving a second portion empty. Next, the second portion of the hollow, flexible member is collapsed around the swellable particle and form a collapsed swellable particle having a volume approximately equivalent to the initial unswelled volume of the swellable material. The collapsed swellable particle is then introduced into the wellbore in the subterranean formation and the swellable particle is swelled so as to adopt a swelled volume beyond the initial unswelled volume and take the shape of the hollow, flexible member so as to form an encased swelled fluid loss particle and seal at least a portion of the fluid loss zone.

In preferred embodiments, the hollow, flexible member has a pre-defined shape and a swellable particle is placed within the hollow, flexible member such that when the swellable particle swells, it fills the space of the hollow, flexible member so as to take on its shape. The hollow, flexible member may also serve to limit the swelling of the swellable particle. Typically, the swellable particle placed into a hollow, flexible member does not have a specific shape that it forms when it is swelled. Rather, it is capable of conforming to the shape of the hollow, flexible member.

Figure 4A:
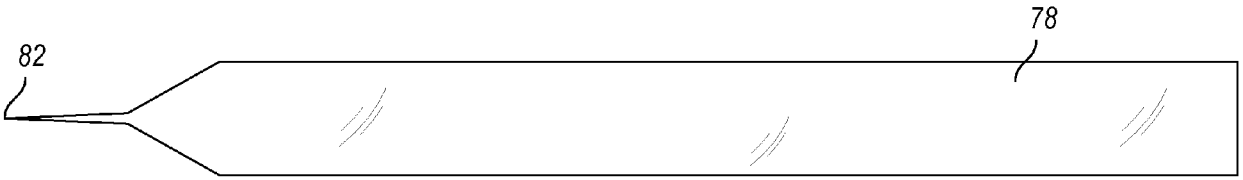
FIGS. 4A, 4B, 4C, and 4D show a hollow, flexible member with at least one closed end (FIG. 4A), having a swellable particle placed within such that it substantially abuts the at least one closed in (FIG. 4B), where the hollow, flexible member is collapsed (FIG. 4C) around the swellable particle (FIG. 4D).
Figure 4B:
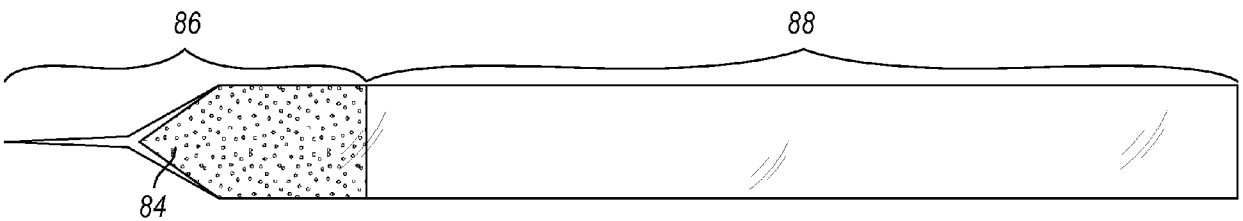
Figure 4C:
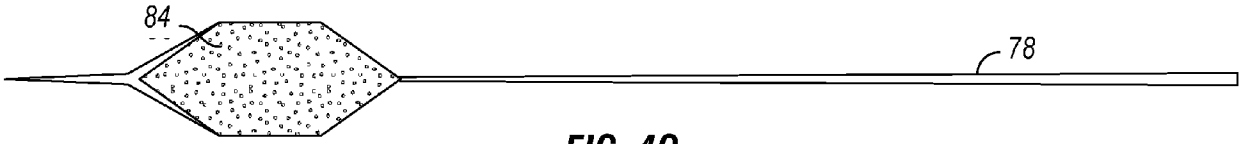
Figure 4D:
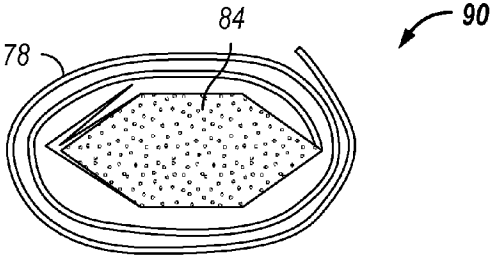

In some embodiments, the hollow, flexible member may have multiple ends and the swellable particle is placed substantially in the center of the hollow, flexible member. In other embodiments, the hollow, flexible member may have multiple ends with at least one closed end. Referring now to the figures, FIG. 4A shows hollow, flexible member 78 with closed end 82. In FIG. 4B, swellable particle 84 having an unswelled volume and is placed into the first portion 86 of hollow, flexible member 78, substantially abutting closed end 82, and a second portion 88 of hollow, flexible member 78 does not house swellable particle 84. In FIG. 4C, the second portion 88 of hollow, flexible member 78 is collapsed, and, as shown in FIG. 4D, the collapsed hollow, flexible member 78 surrounds the swellable particle 84 and forms collapsed swellable particle 90 having substantially the same volume as the unswelled volume of swellable particle 84.

Figure 5:
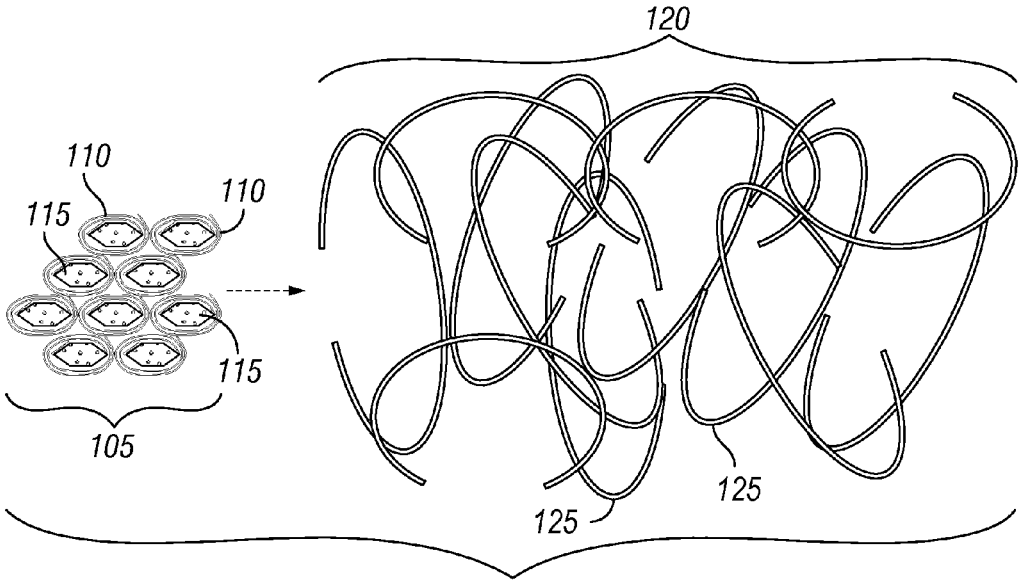
FIG. 5 depicts a crescent-shaped hollow, flexible member after a swellable particle has been placed therein and has swelled.
Figure 6:
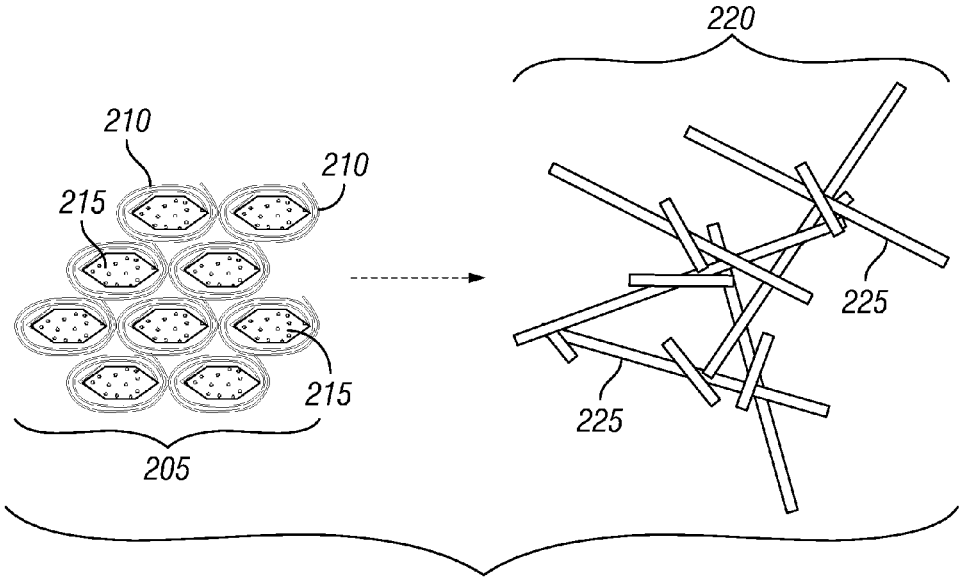
FIG. 6 shows a cylinder-shaped hollow, flexible member after a swellable particle has been placed therein and has swelled.

Like the swellable particles of the present invention, the hollow, flexible members of the present invention may have a predetermined shape which is manifested upon placing a swellable particle into the hollow, flexible member and swelling the swellable particle. Suitable shapes that the hollow, flexible member of the present invention may include, but are not limited to, spherical-shaped; cubic-shaped; rod-shaped; rectangle-shaped; cone-shaped; ellipse-shaped; cylinder-shaped; polygon-shaped; pyramid-shaped; torus-shaped; cross-shaped; lattice-shaped; star-shaped; crescent-shaped; bowtie-shaped; semicircle-shaped; spiral-shaped; and any combination thereof. The shape of the hollow, flexible member may be selected based on the fluid loss zone to be controlled. For example, for large vugular fluid loss zones, it may be preferred to select a high concentration of long, slender shaped hollow, flexible member, such as crescent-shaped hollow, flexible member, that may act alone or may interact with each other so as to form a complex entangled mass. FIG. 5 demonstrates such crescent-shaped hollow, flexible members after the swellable particle has been placed within the hollow, flexible member and has swelled. Collapsed swellable particles 105 comprise swellable particles 115 within crescent-shaped hollow, flexible members 110. Upon swelling the swellable particles, they take the shape of the crescent-shaped hollow, flexible members 110 to form encased swelled fluid loss particles 125, which interact to form entangled mass 120. In other embodiments, hollow, flexible members that are substantially spherical may be preferred. In still other embodiments, hollow, flexible members that are cylinder-shaped, as shown in FIG. 6 are preferred. Collapsed swellable particles 205 comprise swellable particles 215 within cylinder-shaped hollow, flexible members 210. Upon swelling the swellable particles, they take the shape of the cylinder-shaped hollow, flexible members 210 to form encased swelled fluid loss particles 225, which interact to form entangled mass 220.

The hollow, flexible members of the present invention may be formed from any material capable of use in a hydrocarbon well operation, capable of flexibility, and capable of allowing a swelling agent to pass through and contact the swellable particle therein. In some preferred embodiments, the hollow, flexible members are permeable so as to facilitate contact with a swelling agent. Suitable materials for forming the hollow, flexible members of the present invention include, but are not limited to, silk; rayon; a nylon; cellulose; a polyvinyl material; a polyolefin material; a linen; a polypropylene; a permeable plastic material; any derivatives thereof; any copolymers thereof; and any combinations thereof. Suitable permeable plastic materials may include, but are not limited to, polyethylene; monochlorotrifluoroethylene; rubber hydrochloride; a fluoropolymer; a polyamide; polyethersulphone; polyethylene terephthalate; polyetheretherketone; copolymers thereof; derivatives thereof; and any combination thereof.

In some embodiments, the hollow, flexible members of the present invention further comprise an adhesion agent. The adhesion agent is typically located on the outer face of the hollow, flexible member. As used herein, the term "outer face" refers to the portion of the hollow, flexible members that is capable of contacting other hollow, flexible members (e.g., the portion that does not house the swellable particles of the present invention). The adhesion agent may act to encourage individual encased swelled fluid loss particles (after the swellable particles have swelled) to form an entangled mass. The adhesion agents may be particularly useful when a rigid swellable particle is used in accordance with the teachings of the present invention or when particularly linear shaped hollow, flexible members are used. The adhesion agent may be any type of fastener or projection that may aid in contacting one or more encased swelled fluid loss particles together. Suitable adhesion agents may include, but are not limited to, a hook and loop fastener; a loop; a pin; a clip; a wire; a magnet; a hook; a tether; a sticky coating; a textured fabric; and any combinations thereof. In some embodiments, multiple adhesion agents are included on a single hollow, flexible member. The multiple adhesion agents may be of the same type or of different types.

In some embodiments, particulates may be included with the swellable particles of the present invention and introduced together into the wellbore in the subterranean formation. The particulates may synergistically interact with the swellable particles so as to enhance the sealing capacity of a fluid loss zone. That is, if any interstitial spaces exist within, for example, an entangled mass composed of swellable particles, the particulates may fill those voids. Although it is not necessary to include particulates in the methods of the present invention, it may be preferred when particularly large vugular or cavernous fluid loss zones require controlling. The particulates for use in the present invention may be any particulates suitable for use in a hydrocarbon operation and may include, for example, proppant particulates, traditional FLCM particulates, and the like.

Suitable materials for the particulates of the present invention may include, but are not limited to, sand; ground marble; acid soluble solids; bauxite; ceramic materials; glass materials; polymer materials; polytetrafluoroethylene materials; nut shell pieces; cured resinous particulates comprising nut shell pieces; seed shell pieces; cured resinous particulates comprising seed shell pieces; fruit pit pieces; cured resinous particulates comprising fruit pit pieces; wood; composite particulates; and any combination thereof. Suitable composite particulates may comprise a binder and a filler material wherein suitable filler materials includes, but is not limited to, silica; alumina; fumed carbon; carbon black; graphite; mica; titanium dioxide; meta-silicate; calcium silicate; kaolin; talc; zirconia; boron; fly ash; hollow glass microspheres; solid glass; and any combination thereof.

The swellable particles and/or the particulates of the present invention may be introduced into a wellbore in a subterranean formation in any treatment fluid that may be used in a hydrocarbon well operation for controlling a fluid loss zone. Suitable treatment fluids for use in conjunction with the present invention may include, but are not limited to, oil-based fluids; aqueous-based fluids; aqueous-miscible fluids; water-in-oil emulsions; or oil-in-water emulsions. Suitable oil-based fluids may include alkanes; olefins; aromatic organic compounds; cyclic alkanes; paraffins; diesel fluids; mineral oils; desulfurized hydrogenated kerosenes; and any combination thereof. Suitable aqueous-based fluids may include fresh water; saltwater (e.g., water containing one or more salts dissolved therein); brine (e.g., saturated salt water); seawater; and any combination thereof. Suitable aqueous-miscible fluids may include, but are not limited to, alcohols; (e.g., methanol, ethanol, n-propanol, isopropanol, n-butanol, sec-butanol, isobutanol, and t-butanol); glycerins; glycols (e.g., polyglycols, propylene glycol, and ethylene glycol); polyglycol amines; polyols; any derivative thereof; any in combination with salts (e.g., sodium chloride, calcium chloride, calcium bromide, zinc bromide, potassium carbonate, sodium formate, potassium formate, cesium formate, sodium acetate, potassium acetate, calcium acetate, ammonium acetate, ammonium chloride, ammonium bromide, sodium nitrate, potassium nitrate, ammonium nitrate, ammonium sulfate, calcium nitrate, sodium carbonate, and potassium carbonate); any in combination with an aqueous-based fluid; and any combination thereof. Suitable water-in-oil emulsions, also known as invert emulsions, may have an oil-to-water ratio from a lower limit of greater than about 50:50, 55:45, 60:40, 65:35, 70:30, 75:25, or 80:20 to an upper limit of less than about 100:0, 95:5, 90:10, 85:15, 80:20, 75:25, 70:30, or 65:35 by volume in the base fluid, where the amount may range from any lower limit to any upper limit and encompass any subset therebetween. Examples of suitable invert emulsions include those disclosed in U.S. Pat. No. 5,905,061 entitled "Invert Emulsion Fluids Suitable for Drilling" filed on May 23, 1997; U.S. Pat. No. 5,977,031 entitled "Ester Based Invert Emulsion Drilling Fluids and Muds Having Negative Alkalinity" filed on Aug. 8, 1998; U.S. Pat. No. 6,828,279 entitled "Biodegradable Surfactant for Invert Emulsion Drilling Fluid" filed on Aug. 10, 2001; U.S. Pat. No. 7,534,745 entitled "Gelled Invert Emulsion Compositions Comprising Polyvalent Metal Salts of an Organophosphonic Acid Ester or an Organophosphinic Acid and Methods of Use and Manufacture" filed on May 5, 2004; U.S. Pat. No. 7,645,723 entitled "Method of Drilling Using Invert Emulsion Drilling Fluids" filed on Aug. 15, 2007; and U.S. Pat. No. 7,696,131 entitled "Diesel Oil-Based Invert Emulsion Drilling Fluids and Methods of Drilling Boreholes" filed on Jul. 5, 2007, each of which are incorporated herein in reference in their entirety. It should be noted that for water-in-oil and oil-in-water emulsions, any mixture of the above may be used including the water being and/or comprising an aqueous-miscible fluid.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method of treating a fluid loss zone in a wellbore in a subterranean formation comprising:

providing swellable particles having an initial unswelled volume and a first shape, wherein the swellable particles comprise a non-swellable polymer portion that is coextruded adjacent and attached to a swellable polymer portion, wherein the coextrusion is asymmetric, wherein the swellable polymer portion is present in a greater proportion than the non-swellable polymer portion, wherein the swellable particles upon swelling adopt a second shape, and wherein the first and second shape are different due to the swelling of the swellable particle alone, and at least one of the first or second shapes is a cone-shape; a torus-shape; a cross-shape; a lattice-shape; a star-shape; a crescent-shape; a bowtie-shape; or a spiral-shape;

introducing the swellable particles into the wellbore in the subterranean formation; and swelling the swellable particles so as to adopt a swelled volume beyond the initial unswelled volume and the second shape; and sealing at least a portion of the fluid loss zone.

2. The method of claim 1, wherein particulates are introduced into the wellbore and interact with the swellable particles upon swelling to perform the step of sealing at least a portion of the fluid loss zone.

3. The method of claim 1, wherein the initial unswelled volume of the swellable particles is capable of increasing by up to about 400% to adopt the swelled volume.

4. The method of claim 1, wherein the initial unswelled volume of the swellable particles is less than about 15 mm in diameter.

5. The method of claim 1, wherein the swellable particles are formed from the group consisting of a swellable polymer; a salt of swellable polymeric material; and any combination thereof.

6. The method of claim 5, wherein the swellable particles are formed from the coextrusion of at least two materials selected from the group consisting of a swellable polymer; a salt of swellable polymeric material; and a non-swellable polymer.

7. The method of claim 1, wherein the swellable material is water-swellable; oil-swellable; or a combination thereof.

8. A method of treating a fluid loss zone in a wellbore in a subterranean formation comprising:

providing a hollow, flexible member having multiple ends, wherein one end is a closed end;

providing a swellable particle having an initial unswelled volume;

placing the swellable particle into a first portion of the hollow, flexible member, while leaving a second portion empty;

collapsing the second portion of the hollow, flexible member around the swellable particle so as to form a collapsed swellable particle having a volume approximately equivalent to the initial unswelled volume of the swellable material and a first shape;

introducing the collapsed swellable particle into the wellbore in the subterranean formation; and swelling the swellable particle so as to adopt a swelled volume beyond the initial unswelled volume, wherein the swelling of the swellable particle causes the hollow, flexible member and the swellable particle to take a second shape so as to form an encased swelled fluid loss particle, and wherein the first and second shape are different due to the swelling of the swellable particle alone, and at least one of the first or second shapes is a cone-shape;

a torus-shape; a cross-shape; a lattice-shape; a star-shape; a crescent-shape; a bowtie-shape; or a spiral-shape; and sealing at least a portion of the fluid loss zone with the encased swelled fluid loss particle.

9. The method of claim 8, wherein the step of placing the swellable material into a first portion of the hollow, flexible member comprises placing the swellable particle so as to substantially abut the closed end.

10. The method of claim 8, wherein the hollow, flexible member has an approximate center portion and the step of placing the swellable material into a first portion of the hollow, flexible member comprises placing the swellable particle substantially in the center portion.

11. The method of claim 8, wherein particulates are introduced into the wellbore and interact with the encased swelled fluid loss material to perform the step of sealing at least a portion of the fluid loss zone.

12. The method of claim 8, wherein the initial unswelled volume of the swellable particle is capable of increasing by up to about 400% to adopt the swelled volume.

13. The method of claim 8, wherein the hollow, flexible member is comprised of a material having a tensile strength of at least 10 MPa.

14. The method of claim 8, wherein the hollow, flexible member is comprised of a material selected from the group consisting of silk; rayon; a nylon; cellulose; a polyvinyl material; a polyolefin material; a linen; a polypropylene; a permeable plastic material; any derivatives thereof; and any combinations thereof.

15. The method of claim 8, wherein the initial unswelled volume of the swellable particle is less than about 15 mm in diameter.

16. The method of claim 8, wherein the hollow, flexible member further comprises an adhesion agent.

17. The method of claim 16, wherein the adhesion agent is selected from the group consisting of a hook and loop fastener; a loop; a pin; a clip; a wire; a magnet; a hook; a tether; a sticky coating; a textured fabric; and any combinations thereof.

18. The method of claim 8, wherein the swellable particles are formed from the group consisting of a swellable polymer; a salt of swellable polymeric material; and any combination thereof.

19. The method of claim 8, wherein a plurality of encased swelled fluid loss particles are introduced into the wellbore in the subterranean formation.

* * * * *